United States Patent [19]

Bianchi et al.

[11] Patent Number: 4,591,081

[45] Date of Patent: May 27, 1986

[54] AMBIDEXTROUS HOLSTER

[75] Inventors: John E. Bianchi; Richard D. E. Nichols, both of Fallbrook, Calif.

[73] Assignee: Bianchi Intl. Inc., Temecula, Calif.

[21] Appl. No.: 575,313

[22] Filed: Jan. 30, 1984

[51] Int. Cl.[4] ..... F41C 33/02

[52] U.S. Cl. ..... 224/192; 224/198; 224/238; 224/243; 224/911

[58] Field of Search ..... 224/243, 192, 198, 238, 224/911, 912

[56] References Cited

U.S. PATENT DOCUMENTS

| | | | |
|---|---|---|---|
| 2,765,968 | 10/1956 | Gaylord | 224/198 |
| 3,688,953 | 9/1972 | Bianchi | 224/911 X |
| 4,258,871 | 3/1981 | McMahon | 224/192 |
| 4,312,466 | 1/1982 | Clark | 224/243 |
| 4,408,706 | 10/1983 | Hurley | 224/192 |

*Primary Examiner*—Stephen Marcus
*Assistant Examiner*—David Voorhees
*Attorney, Agent, or Firm*—John E. Wagner

[57] ABSTRACT

A handgun holster having a separable flap for covering part of the top opening of the holster pocket. The flap is secured by separable fasteners having one part of the fastener on the holster body and a mating fastener part on the flap on one side of the holster and a second separable fastener on the other side of the holster body having one fastener part on the holster body and a mating fastener part on the cover flap which secures the second side of the cover flap and also secures a belt loop to the holster body.

11 Claims, 14 Drawing Figures

12
10
11
14
15
22
22A
22B
22C
23
23A
23B
23C
24
25
26
27
28
32
34
36
37
38
42
43
44
50
5C

AMBIDEXTROUS HOLSTER

BACKGROUND OF THE INVENTION

A long felt need has existed for an improved holster, particularly for use by military personnel as a standard sidearm carrying holster. Usually automatic handguns are carried as standard sidearms, weighing in the order of 30 to 40 ounces or more with a fully loaded clip. The handgun is worn with either a web or garrison belt and must be worn by both left and right handed personnel. In the past, left and right handed holsters of web-like fabric have been used with metal clip belt loops.

An improvement in military type holsters which fit both garrison and web belts and which serve both left and right handed personnel is disclosed in U.S. Pat. No. 3,688,953 co-inventor to John E. Bianchi. Holsters, in accordance with that patent, include dual belt loops on both sides of the holster body and a flap which is secured by rotatable removable fasteners which may be removed from either side of the holster body. Thus, the holsters made in accordance with U.S. Pat. No. 3,688,953 may be worn by either left or right handed personnel, side or cross draw, and on either garrison or web belts. This type of holster constituted a significant advance in military type holsters.

We have determined, however, that holsters of the type disclosed in U.S. Pat. No. 3,688,953 are bulkier than is desirable, having virtually double thickness on both the inner and outer sides of the holster at all times. The extra thickness on the outer side adds to bulkiness adjacent to the wearer's arm and is nonfunctional. Also, owing to the nature of the double belt loops, the holster tends to ride with a high center of gravity. In certain cases, a high center of gravity is desirable, but when carrying heavier weapons as the Colt government .45 automatic, the high center of gravity is not desired.

BRIEF DESCRIPTION OF THE INVENTION

Faced with the foregoing state of the art, I have sought to design a holster which has all of the favorable attributes of the Bianchi No. 3,688,953 patent holster but with reduced bulk, cost and greater utility.

We have accomplished each of these objectives employing a holster, preferably of leather or leather-like material but optionally of fabric such as foam cushioned laminated ballistic nylon material or of web type material. The holster includes a body formed into a pouch for holding a handgun and has a seam at the rear and usually across the bottom. The front of the holster may include an integrally formed sight groove and the upper end of the front of the holster body may be enlarged as compared to the narrowed sight groove in order to accommodate larger rear sights. The body portion of the holster generally conforms to the slide or barrel portion of the handgun to be used, and extends upward at the front to approximately the level of the hammer, and at the rear to the level of the trigger guard.

In this holster, the flap which covers the hammer, the sights, and grip of the handgun is generally shaped in a inverted U as in the case of earlier holsters, however it is removably secured to the holster body by a snap fastener on one side and by semi-permanent fasteners on the opposite side, both on the inner faces of the flap. The semi-permanent fasteners may use screws and mating nuts such as T-nuts or conventional nuts, and locknuts or for that matter snap fasteners may be used. The semi-permanent fasteners, however, are preferably of the 90 degree turn to lock and 90 degree turn to unlock type. These are commonly called quarter-turn fasteners. When in a locked position, they are the equivalent, mechanically, to a permanent connection of the flap to the holster body.

Mating or receiving portions of the quarter-turn fasteners are secured to the holster body at approximately the level of the trigger guard although the level may vary with different types of handguns.

The flap carries on its outer surface, a belt loop assembly which is reversible from side to side of the holster as the holster flap is reversed.

The fastener parts secured to the holster body have their bases adjacent to the outer surface of the holster body and their outer or working faces are exposed through openings in a shaped cover. The cover is preferably of the same material as the flap which includes a cutout corresponding in size and shape to the cover. Thus the flap, when secured to the holster body, lies against the body of the holster without additional thickness on the belt loop side by reason of the presence of the cover.

The quarter-turn fasteners, in addition to securing the flap to the holster body, close the bottom of the belt loop.

In one embodiment, a plurality of identical sets of quarter-turn fasteners and covers are located at different heights on each side of the holster body whereby the height of the holster may be selected to change the center of gravity to any of a number of levels while maintaining a solid connection between the flap, belt loop and the holster body.

Also characteristic of this invention is the fact that the holster body and flap have become modular by reason of this invention and may be substituted in other combinations, for example, the belt loop may be removed and a shoulder strap assembly be substituted to make a shoulder holster. Similarly, a chest strap assembly may be substituted for the belt loop and the holster becomes a chest holster. Numerous variations are possible employing this invention.

BRIEF DESCRIPTION OF THE DRAWING

This invention may be more clearly understood from the following description and by reference to the drawing, in which.

DETAILED DESCRIPTION OF THE INVENTION

Figure 1:
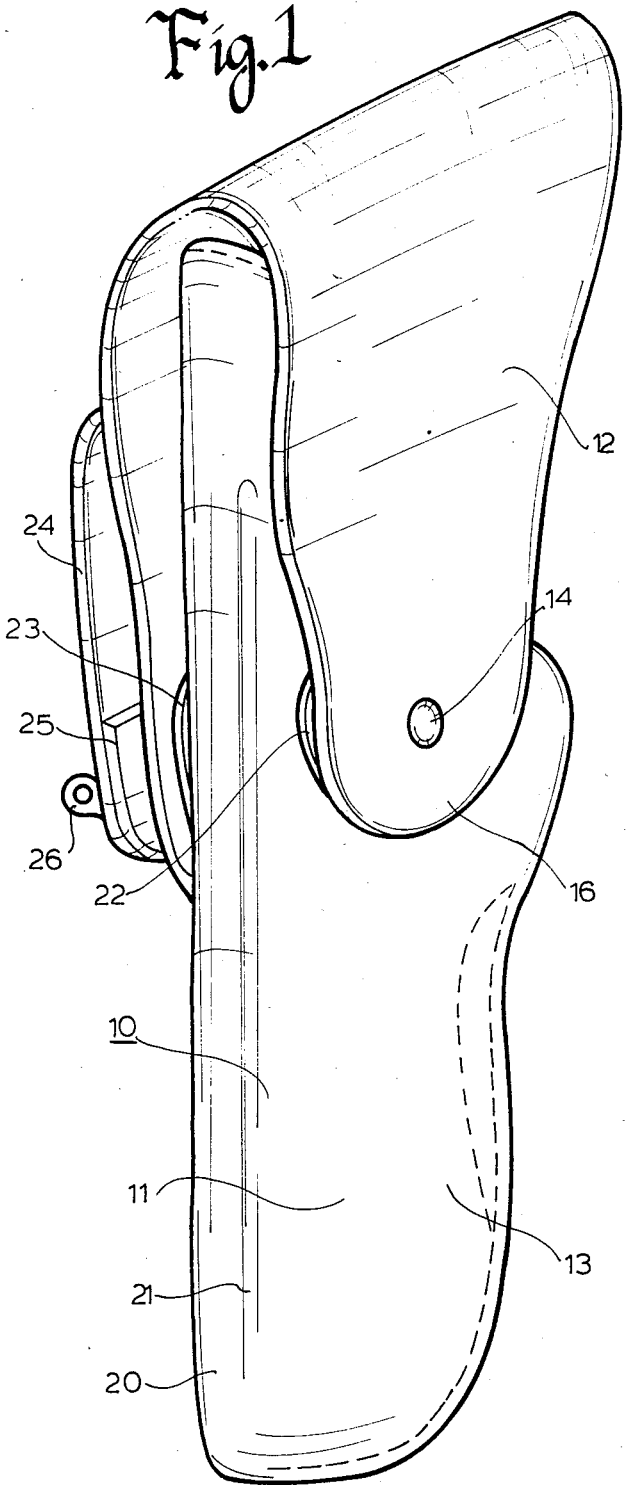
FIG. 1 is a perspective view of a holster in accordance with this invention.

In FIG. 1, a view of a first embodiment of this invention as seen from the front of a person wearing it on his left hip may be seen. There, a holster 10 appears including a body 11 of leather or leather-like material which defines a handgun carrying pocket and a flap 12, secured to the body 11 at the near or outer side 13 by a snap fastener 14 which engages a mating fastener part secured to the body 11. The mating fastener part 15, unshown in FIG. 1, may be seen in FIG. 3. The fastener 14–15 may be of the one-direction to open type or may be a conventional snap fastener which will disengage when the edge 16 of the flap 12 is lifted from any direction. For this application, I have found that a conventional snap fastener is desirable.

Figure 5C:
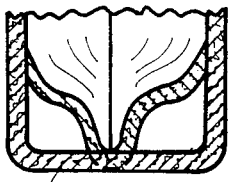
FIG. 5C is a fragmentary horizontal sectional view of the embodiment of FIG. 1 taken along line 5C—5C of FIG. 5B.

The body 11 of the holster 10 includes an integrally formed longitudinally extending sight groove, unseen in FIG. 1 but appearing in FIG. 5C, described below. From the exterior, the sight groove appears as a ridge 20 formed at the front edge of the holster, and a pair of indentation grooves at opposite sides of the holster body 11, one groove 21 appearing in FIG. 1. The sight groove within the holster 10 allows the front sight of the handgun to extend to the bottom of the holster upon entrance and exiting the holster without contact with the holster body material. Toward the upper end of the holster body 11, the sight groove ends leaving the upper end enlarged and capable of receiving the rear sight of a handgun without contact. This arrangement protects both the front and rear sights, and the holster body as well, from damage through contact during drawing or replacing the handgun in the holster.

Beneath the edge 16 of the flap 12, the edge of a cover 22 may be seen. It is part of a significant feature of this invention as is explained below in connection with FIGS. 4 and 5. A similar cover 23, also with only an edge showing, appears on the opposite side of the body 11.

A belt loop 24 appears on the opposite side of flap 12, including a reinforcing tab 25 and the wing handle 26 of a quarter-turn fastener, better seen in FIG. 6.

The holster 10, as may be clearly seen in FIG. 1, provides protection for the entire handgun except that the grip and trigger guard may extend slightly out of the rear of the holster 10. This configuration provides at least as great protection for the handgun carried as do prior military type holsters.

Figure 3:
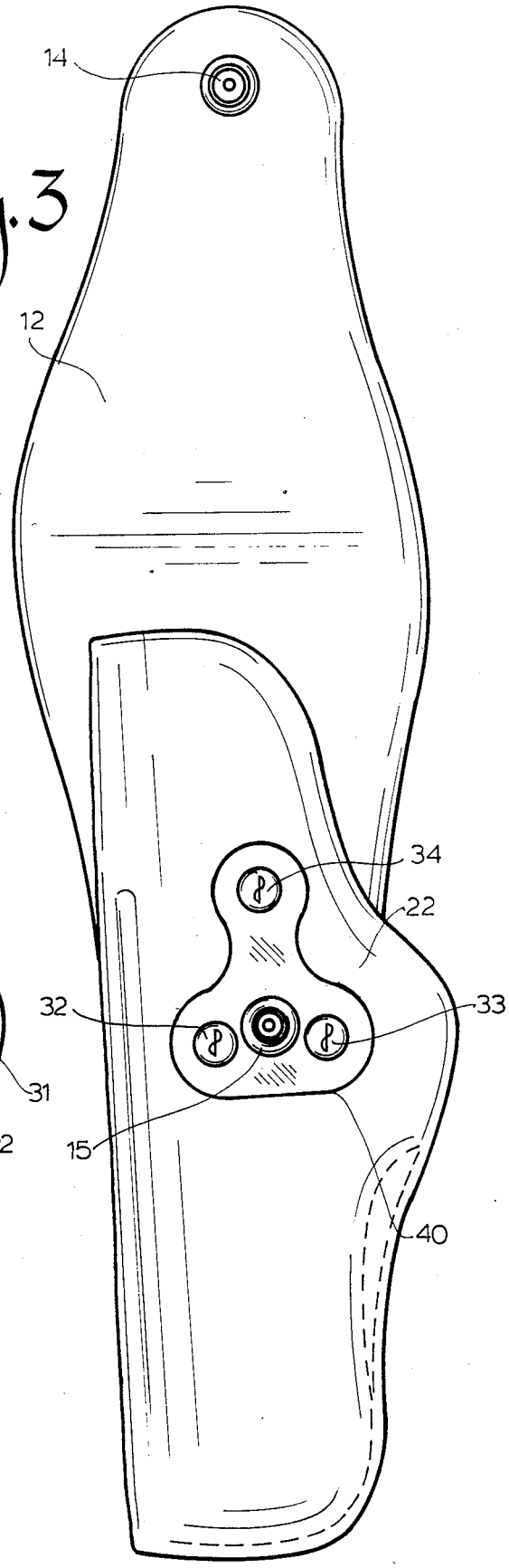
FIG. 3 is a side elevational view of the holster of FIGS. 1 and 2 with the flap raised.
Figure 2:
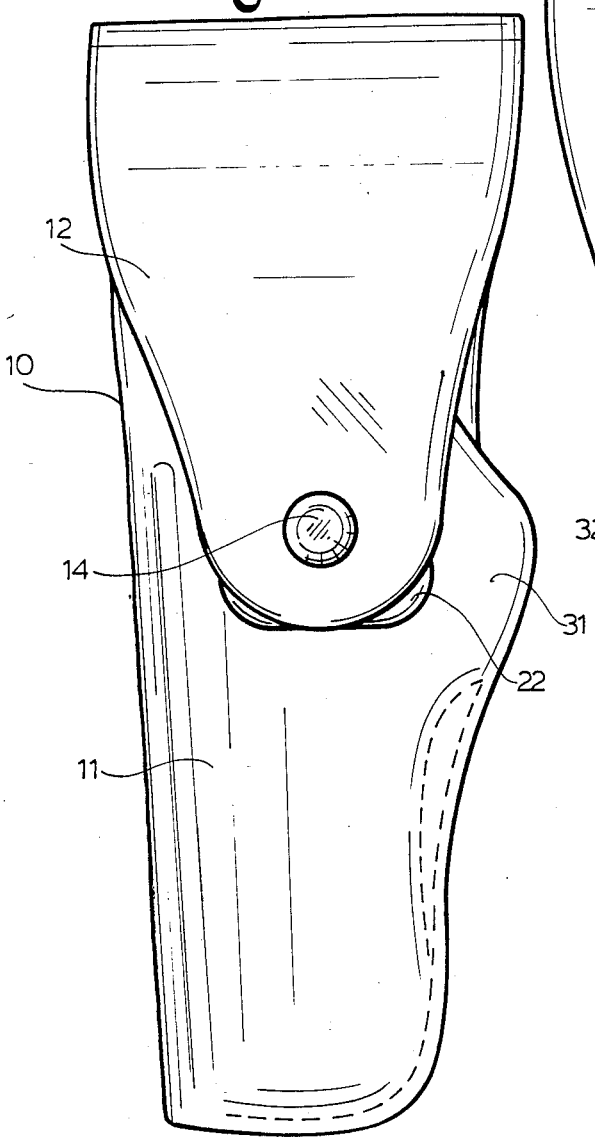
FIG. 2 is a side elevational view of the holster of this invention with the side flap closed.

Now referring to FIGS. 2 and 3, the holster 10, when viewed from the outer side, may be seen. For this discussion the outer side is used to identify the side on which the snap fastener 14 is located at that time, remembering that the flap 12 is reversible, and in doing so the holster becomes ambidextrous and the opposite side becomes the outer side.

Referring now to FIG. 2, the relative positioning of the flap 12, when closed is apparent as is the trigger guard protecting portion 31 which is only slightly visible in FIG. 1. Also slightly visible in FIG. 2 is the cover 22 lying beneath the edge region 16 of the flap 12.

In FIG. 3, the cover 22 may be seen as a shaped piece of leather or material similar to that of the body 11 or flap 12 and mounting the snap fastener part 15 which mates with the outer fastener part 14. A primary function however of the cover 22, giving rise to its name, is to hold and cover the fixed parts 32, 33 and 34 of the quarter turn fasteners which hold the belt loop 24 and the flap 12 in place securely on the holster body 11. The member 22 covers the edge flanges of the quarter-turn fastener parts 32, 33 and 34 and additionally holds them in place against the body 11. The outer edge 40 of the cover 22 also serves an important function in that it is selected in shape to be noncircular and conforms to a recess in the inner face of the flap 12 on the opposite side of the flap from the snap fastener 14. The recess, which is identified as 50, appears in FIG. 5A. The frictional contact of the edges and the recessed mating of the cover 22 and the recess 50 provide a degree of rigidity to the flap 12 and belt loop 4 when secured to the holster body 11, greater than is achieved by quarter-turn fasteners alone.

Figures 4A, 4B, 4C, 5A, 5B, 6A, 6B:
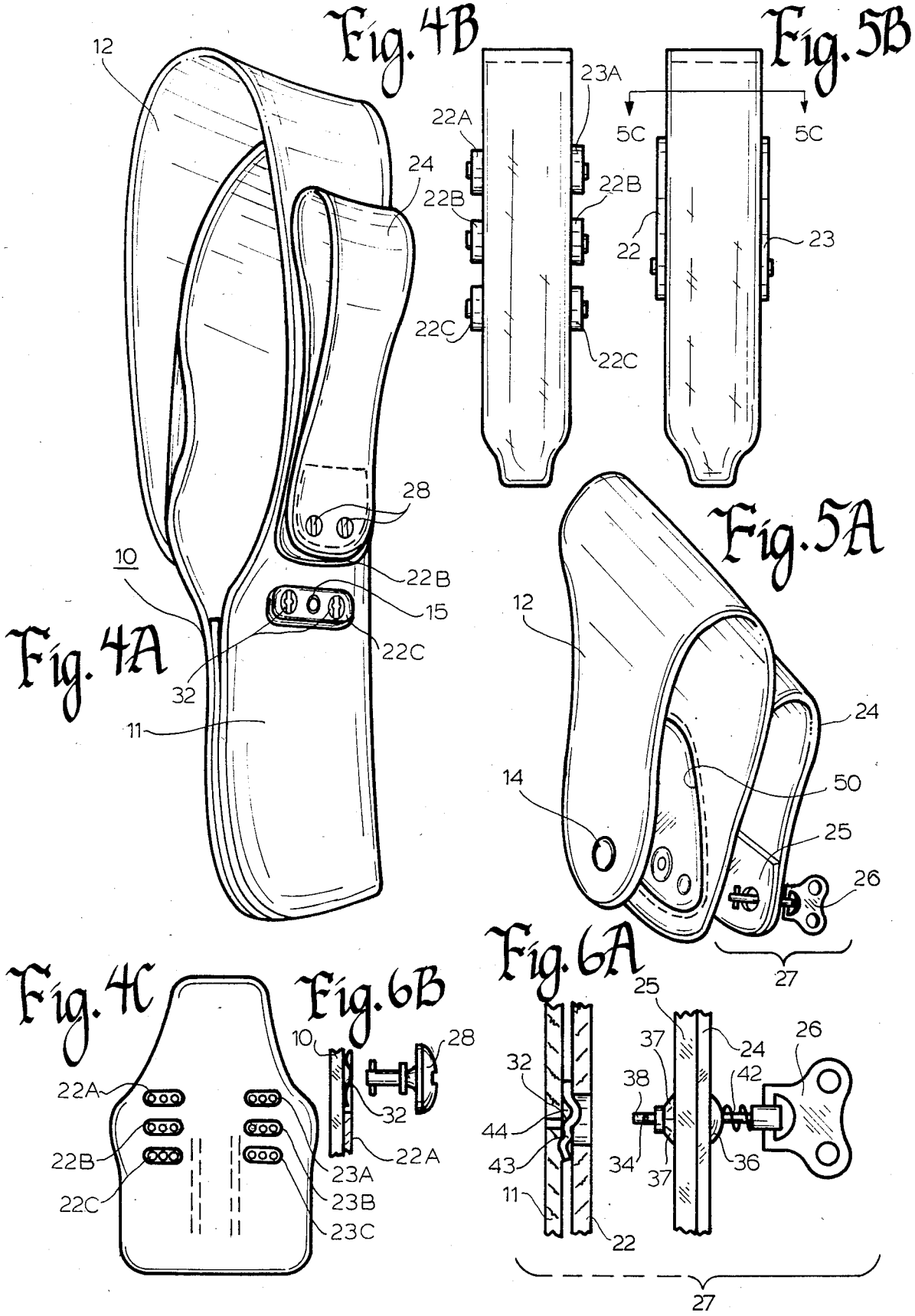
FIG. 4A is an inner side perspective view of another embodiment of this invention with the belt loop closed and using a different type of quarter-turn fastener than used in FIG. 1.
FIG. 4B is a front elevational view of the holster of FIG. 4A showing its multiple level attachment feature.
FIG. 4C is a front elevational view of the holster body of FIG. 4A, laid out open to shown all of the multiple mounting locations for the belt loop.
FIG. 5A is a perspective, opened view of the flap assembly of this invention.
FIG. 5B is a front elevational view of the holster body of this invention as illustrated in FIG. 1.
FIG. 6A is a fragmentary sectional view showing the belt loop and flap fasteners taken along lines 6—6 of FIG. 5B.
FIG. 6B is a side elevational view of the screw type quarter-turn fastener of FIG. 4A.

The feature of adjustable height is achieved employing the features of FIGS. 4A, B and C. In FIG. 4A, the holster 10 includes flap 12 and belt loop 24, ostensibly similar to their counterparts of FIGS. 1–3. In this case however, the cover 22 is in fact three covers 22A, 22B and 22C on one side and 23A, 23B and 23C on the opposite side of the holster body 10. These covers 22A–C and 23A–C are again noncircular, being elongated with rounded ends. They cover fixed fastener parts 32 of the type better shown in FIG. 6A, and centrally located snap fastener parts 15, of the type illustrated in FIG. 3.

In the embodiment of FIGS. 4A–C, three sets of fasteners are shown on each side under respective covers 22A–C and 23A–C at different levels whereby the belt loop 24, and incidentally the cover 12 may be mounted at three different levels. This allows the user to not only select the side on which the holster 10 will be worn, front or cross draw, but holster levels as well.

Selection of levels is accomplished at the same time that the side is selected. As shown in FIG. 4A, the middle level has been selected by securing the belt loop 24 and flap 12 to the fasteners 32 underlying cover 22B by screw type quarter-turn fasteners 28.

In each of these positions, the holster is equally secure.

Referring now to FIG. 5A, the recess 50, identified above, may be seen in flap 12. The recess 50 conforms in shape to the covers 22 and 23 which are shown in FIG. 5B on opposite sides of the holster body 11. Either of these covers 22 or 23 will fit within the recess 50, with the edges of the recess and of the particular cover 22 or 23 in engagement or near engagement for secure positioning of the flap assembly made up of flap 12, belt loop 24 and fastener 27.

The function of the quarter-turn fastener is best illustrated by reference to FIG. 6A which shows such a device 27 made up of the outer portion 35 including wing handle 26 and its inner locking plate or member 32. The outer portion 35 is secured to the belt loop 24 and its reinforcement 25 by an outer ring or flange 36 and an inner spring flange 37. The fastener 27 has a shaft 38 and locking pin 39. It is spring loaded outwardly by a spring 42 which must be depressed by pressure exerted inwardly by wing handle 26 to press the shaft 38 forward and through a central opening in plate 32. The plate 32 includes a transverse slot to receive the locking pin 39. After the locking pin 39 has passed plate 32, a 90 degree turn of wing handle 26 locks the pin 39 behind the plate 32. Locking is assured by detents 43 and 44.

To release the fastener 27, the shaft 38 must be further depressed inwardly to clear the detents 43 and 44, the wing handle 26 turned 90 degrees and released. The spring 42 retracts the fastener, and the lower end of the belt loop 24 is disengaged from the flap 12 and both are disengaged from that side of the holster body 11. When snap fastener 14 is released from its mate 15, either before or after release of each of the fasteners 27, the lap assembly is totally free from the holster body 11 and may be reversed to change the handedness of the holster.

Figure 7:
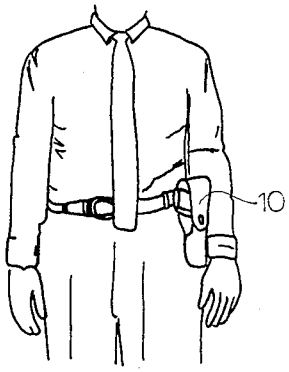
FIG. 7 is a view of the holster of this invention being worn as a right hand cross draw holster.
Figure 8:
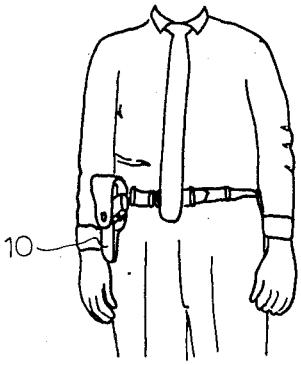
FIG. 8 is a view of the holster of this invention being worn as a left hand cross draw holster.
Figure 9:
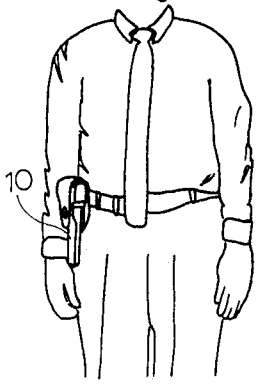
FIG. 9 is a view of the holster of this invention being worn in a right hand normal draw position.

Examples of the appearance of the holster in both the right hand cross draw mode and left hand cross draw mode are illustrated in FIGS. 7 and 8 respectively. The use of the holster in a normal right hand mode is illustrated in FIG. 9.

The foregoing embodiments are merely illustrative of this invention and intended to illustrate the best mode known to the inventor at this time but are not to be considered as limiting. Rather the scope of this invention shall be defined by the following claims including their equivalents.

We claim:

1. An ambidextrous holster comprising:

a body of material formed to define a pocket for holding a handgun with an opening for the entrance and exit of the handgun;

a separable flap for securement to said holster to cover at least part of said opening;

said flap and holster body including first fastener means including a pair of fastener parts, one part on the flap and the other part on the holster body, said first fastener means being normally openable and closable by the user during normal introduction and removal of the handgun from the holster;

second fastener means on said holster comprising a pair of fastener parts, one secured to the holster body;

belt loop means securable to the exterior of said flap by said second fastener means;

whereby securement of said second fastener means parts together secures said belt loop means and flap to said holster body.

2. The combination in accordance with claim 1 wherein said second fastener means comprises at least one quarter-turn fastener.

3. The combination in accordance with claim 1 in which said second fastener means is normally unfastenable only when the holster is removed from the wearer.

4. The combination in accordance with claim 1 wherein said holster body includes first and second fastener means parts on both sides of the holster body whereby the flap may be reversed with respect to the holster body to change the handedness of the holster.

5. The combination in accordance with claim 1 wherein said belt loop is permenantly secured at one end to said flap and the other end thereof is secured by said second fastener means to said flap to define a belt loop secured to said holster.

6. The combination in accordance with claim 1 wherein said flap and holster body include a mating recess and protrusion in the region of said second fastener means whereby said mating recess and protrusion provide close engagement of said flap and holster body when said second fastener means is engaged.

7. The combination in accordance with claim 6 wherein said mating recess and protrusion are non circular whereby their engagement provides resistance to rotation of the flap with respect to the holster body.

8. The combination in accordance with claim 6 wherein the protrusion is located on the holster body and the recess is in the flap.

9. The combination in accordance with claim 8 wherein said protrusion comprises a cover overlying at least part of said second fastener means secured to said holster body.

10. The combination in accordance with claim 8 wherein said protrusion on said holster body mounts a part of said first fastener means.

11. The combination in accordance with claim 6 wherein said mating recess and protrusion are generally triangular in shape.

* * * * *